United States Patent [19]

Spitz

[11] Patent Number: 4,502,509

[45] Date of Patent: Mar. 5, 1985

[54] COLLAPSIBLE TURBULATOR

[76] Inventor: William Spitz, 315 E. 68th St., New York, N.Y. 10021

[21] Appl. No.: 573,041

[22] Filed: Jan. 25, 1984

Related U.S. Application Data

[63] Continuation of Ser. No. 304,033, Sep. 21, 1981, abandoned.

[51] Int. Cl.[3] ..... B01F 15/06; F15D 1/02

[52] U.S. Cl. ..... 138/37; 138/38; 138/39; 165/109 T

[58] Field of Search ..... 138/37, 38, 39; 366/337, 339; 403/100, 102; 165/109 T, 146, 179

[56] References Cited

U.S. PATENT DOCUMENTS

| | | | |
|---|---|---|---|
| 2,660,198 | 11/1953 | Morrow | 138/38 |
| 2,861,596 | 11/1958 | Ipsen | 138/38 |
| 2,903,771 | 9/1959 | Madeira . | |
| 3,230,755 | 1/1966 | Brock et al. . | |
| 4,044,796 | 8/1977 | Smick | 138/38 |

FOREIGN PATENT DOCUMENTS

| | | | |
|---|---|---|---|
| 57298 | 7/1912 | Austria | 138/38 |
| 55417 | 9/1910 | Switzerland | 138/38 |

*Primary Examiner*—James E. Bryant, III

*Attorney, Agent, or Firm*—Pennie & Edmonds

[57] ABSTRACT

Collapsible turbulator (10) comprises a plurality of substantially rigid sections (12), structure (14) for connecting the sections (12) in end to end relation for relative pivotal movement between an extended position wherein adjacent sections (12) are substantially coplanar, and an operative position wherein adjacent sections (12) are angularly oriented relative to one another, and structure (30) secured to one of the sections (12) for effecting movement of the sections (12) between the extended and operative positions. A method of inserting the turbulator (10) in a bent pipe (36) is also disclosed.

13 Claims, 14 Drawing Figures

62
30
60
64
66
66
46
32
15
12n
14
14
46
14
36
30
14
10
40
12a
42
14
45
44
30
38
46
32
15
12n
14
14
46
14
36
30
10
14
38
44
50
54
12a
52
56
58
30
48
14

52
44
12a
30
48
68
70
46
15
12n
32
14
36
10
50
6B
58
60
38
8
9

COLLAPSIBLE TURBULATOR

This is a continuation of application Ser. No. 304,033 filed Sept. 21, 1981, now abandoned.

TECHNICAL FIELD

This invention pertains to turbulators, and more particularly to a collapsible turbulator adapted for insertion in piping having a bend therein.

BACKGROUND ART

Turbulators are, of course, well known, and come in a wide variety of configurations. Those of interest here are elongate and include a plurality of angular bends, such that when viewed from the side the turbulator presents the appearance of a triangular wave, and upon installation in a pipe, alternate wave peaks abut opposite sides of the pipe wall. Because of their shape, these turbulators are difficult, if not impossible, to install in pipes having elbow bends and the like. It is therefore an object of the present invention to provide a turbulator of the type described which may be installed in a length of piping having a bend therein.

DISCLOSURE OF THE INVENTION

According to the present invention, I have invented a collapsible turbulator particularly intended for installation in a length of piping having a bend therein. The preferred collapsible turbulator comprises a plurality of rigid, substantially elongated sections hingedly secured in end to end relation for relative pivotal movement between an extended position where the turbulator sections are substantially coplanar, and an operative position wherein the turbulator sections are angularly oriented relative to one another. Actuating means such as a cable is secured to a section at one end of the turbulator for moving the sections between the extended and operative positions. The cable is threaded through holes provided in the remaining sections, except for the section at the other end of the turbulator.

To install the turbulator in the bent pipe, the turbulator is suspended from the other end section above an open end of the pipe. The turbulator is then lowered into the pipe. When said one end section strikes the pipe in the vicinity of the bend, its connecting hinge accommodates sliding movement of that section around the bend along the pipe wall. Likewise, the trailing hinges of the remaining sections accommodate movement of those sections around the bend. The free end of said one end section preferably includes a bent portion which presents a smooth surface to the pipe wall to prevent snagging during installation.

The turbulator is lowered into the pipe until all but said other end section has moved around the elbow. Said other end section is then secured to the pipe wall whereupon the free end of the cable is pulled away from said one end section, as by a winch. This exerts a compressive force on the turbulator tending to pull the turbulator sections closer together. As a result, the sections move toward their operative positions until alternate hinges abut opposite sides of the pipe wall, whereupon further movement is not possible. The turbulator is then in its operative position, whereupon installation is completed by securing the free end of the cable against movement relative to the pipe, as by securing the cable to an eye bolt in the pipe wall.

Except for the hinge connecting said other end section to its adjacent section, which hinge is preferably perpendicular to the longitudinal axes of the sections, the remaining hinges are all preferably angled relative to said longitudinal axes. As a result, when the sections are moved to their operative positions, their faces are oblique relative to the axis of the pipe. This is desirable as it is known that this maximizes the effect of the turbulator.

The above as well as further features and advantages of the preferred collapsible turbulator and installation method in accordance with the present invention will be more fully apparent from the following detailed description and annexed drawings of the presently preferred embodiments thereof.

BEST MODE FOR CARRYING OUT THE INVENTION

Figure 1:
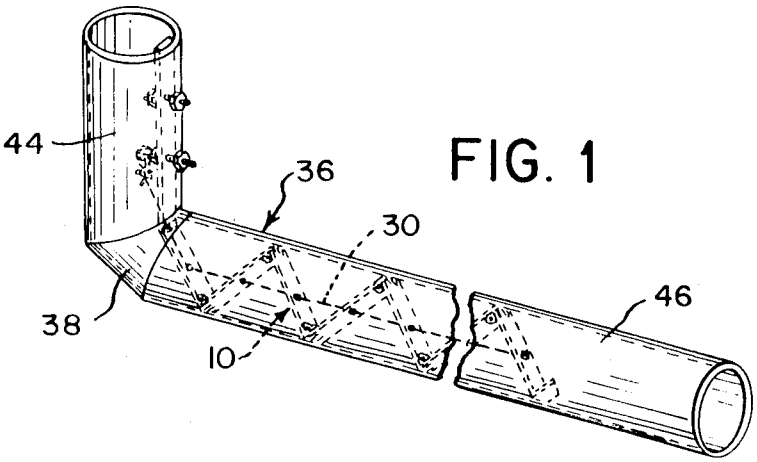
FIG. 1 is a broken perspective view, partly in phantom, showing the turbulator of the present invention installed in a length of piping having an elbow bend therein.

Referring now to the drawings, and initially to FIGS. 1-9 thereof, the preferred collapsible turbulator in accordance with the present invention is generally designated by the reference numeral 10. As shown, the tubulator 10 comprises a plurality of rigid sections **12*a*-12*n* joined together by hinges 14. All of the turbulator sections 12 are planar, except for the sections 12*n*, which preferably includes a bent portion 15. The reason for the bent portion 15 will be explained hereinafter. As usual, the turbulator 10** is preferably comprised of a metal or metal alloy.

Figure 2:
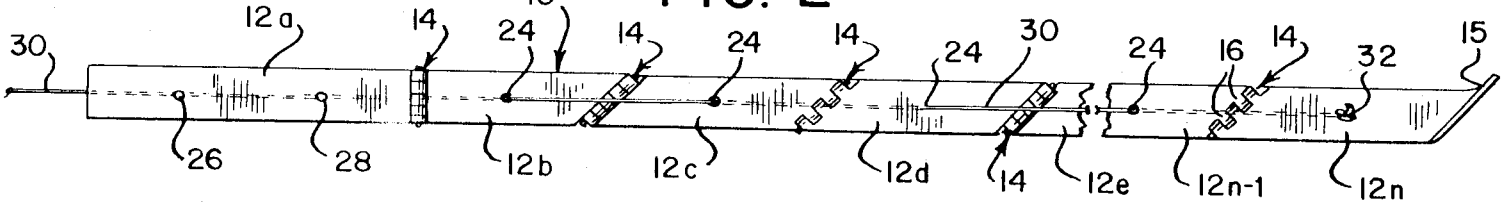
FIG. 2 is a broken top plan view of a collapsible tubulator in accordance with the present invention.
Figure 3:
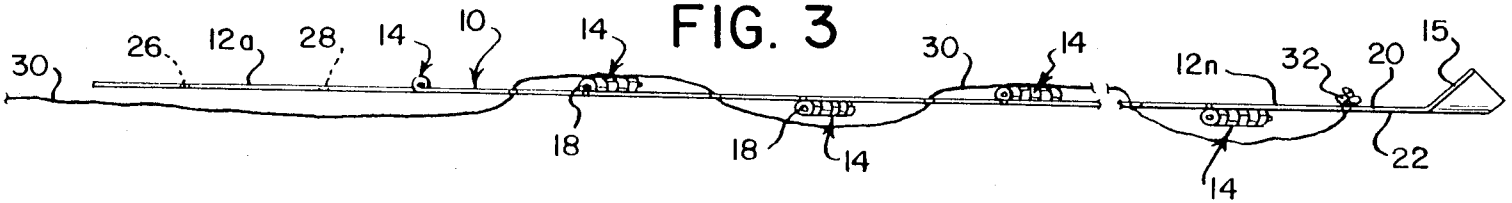
FIG. 3 is a side elevation of the turbulator illustrated in FIG. 2.

As best shown in FIGS. 2 and 3, the hinges 14 are preferably integrally formed with the sections 12. Preferably, each hinge 14 defines a pivot axis and connects ends of adjacent turbulator sections 12 together for pivotal movement about that pivot axis. As the structure and operation of the hinges 14 shown in the drawings is well known, a detailed description is deemed unnecessary. Suffice it to say that each hinge 14 comprises interlocking tubular projections 16 on adjacent sections 12, the projections 16 being joined together by a pin or bolt 18. As shown in FIG. 2, and for reasons that will become more fully apparent hereinafter, except for the hinge 14 joining the sections 12*a* and 12*b* which is perpendicular to the center line of the turbulator 10, all the remaining hinges 14 are angled relative to the center line. Also for reasons that will be apparent hereinafter, the bodies of the angled hinges 14 alternately project from the upper and lower surfaces 20 and 22, respectively, of the turbulator 10.

Still referring to FIGS. 2 and 3, each secton 12 is provided with a preferably centered hole 24, except for the section 12*a*, which is preferably provided with two spaced holes 26, 28. A flexible cable 30, preferably comprised of metal or metal alloy strands, is connected to front turbulator section 12*n*, extends rearward therefrom, and is threaded through the holes 24 such that it alternately extends along the top and bottom surfaces 20 and 22 of the turbulator 10 when the turbulator is laid out flat (FIG. 3). In this way, cable 30 alternately extends above and below adjacent hinges 14. The end of the cable 30 terminating at the hole 24 in section 12*n* may be connected to turbulator section 12*n*, and is secured against passage through hole 24 by tying a knot in the cable or applying an oversized crimp 32 to the end thereof. Alternatively, and as presently preferred, a U-bolt is connected to section 12*n* and the cable 30 is connected to the U-bolt as with an eye splice. In such event, hole 24 in section 12*n* is unnecessary.

Figures 4, 5, 6B:
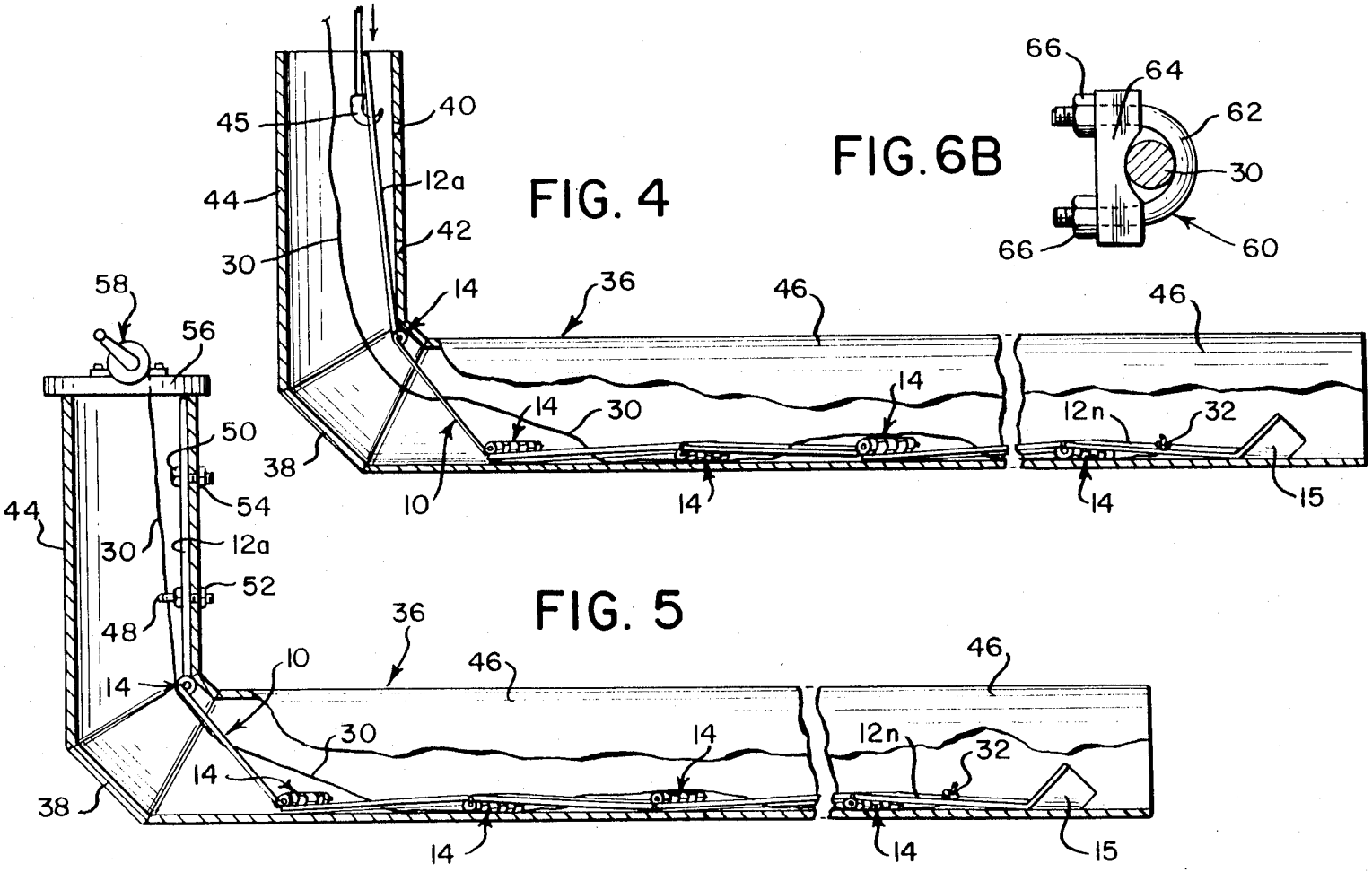
FIG. 4 is a broken side elevation, partly in section, showing a step in the installation of the collapsible turbulator of the present invention.
FIG. 5 is a view similar to FIG. 4 showing another step in the installation procedure.
FIG. 6B is a sectional view taken substantially along the lines 6B—6B in FIG. 6A.

Referring now to FIGS. 1 and 4–9, and initially to FIG. 4, the manner of installing the preferred turbulator 10 in a pipe 36 comprising pipe legs 44, 46 connected by elbow 38 will now be described. Referring initially to FIG. 4, prior to the installation procedure, a pair of holes 40, 42 is drilled in the wall in pipe leg 44. For reasons that will soon be apparent, the spacing between the holes 40, 42 is the same as that between the holes 26, 28 in the section 12*a* of the turbulator 10. The turbulator 10 is initially suspended above the open end of pipe leg 44 as by passing a crane hook 45 through the hole 26 in the section 12*a*. The turbulator 10 is then lowered into the pipe leg 44. When the bent portion 15 of the tubular section 12*n* contacts the pipe wall in the vicinity of elbow 38, section 12*n* pivots about its connecting hinge 14, thereby allowing the section 12*n* to move around the eblow and slide into the pipe leg 46 along the bottom wall thereof. As the insertion process continues, each successive section 12 pivots about its respective trailing hinge 14 whereupon those sections also move around the elbow 38 and into the pipe leg 46. It will now be apparent that the turbulator section 12*n* includes a bent portion 15 to provide a rounded or smooth leading surface 48 to minimize the possibility of snagging during installation.

Lowering of the turbulator 10 into the pipe leg 44 is continued until the turbulator 10 assumes the position illustrated in FIG. 4. As shown in the FIG. 4, when insertion is completed, the turbulator section 12*a* extends inside the pipe leg 44, the section 12*b* extends through the elbow 38 to the bottom of the pipe leg 46, and the remaining sections 12*c*–12*n* lay substantially flat on the bottom of the leg 46. It is presently contemplated that attainment of the position illustrated in FIG. 4 will be determined by visual inspection.

After reaching the position illustrated in FIG. 4, the section 12*a* is secured to the wall of the leg 44. As preferred and shown in FIG. 5, this is preferably accomplished by bolts 48, 50 and nuts 52, 54. More particularly, the position of the section 12*a* is adjusted until the holes 26, 28 are aligned with the holes 40, 42, respectively. The bolt 48 is then passed through aligned holes 28 and 42 whereupon the bolt is loosely secured by the nut 52. The hook 45 is then removed, and the bolt 50 inserted through aligned holes 26 and 40 and thereafter secured by nut 54. The nuts 52 and 54 may then be tightened until section 12*a* is substantially flush against the wall of pipe leg 44. The bolt 48 preferably comprises an eye bolt. Preferably after the nuts 52 and 54 have been tightened, the cable 30 is threaded through the eye bolt 48, and then secured to the winch 58.

Figures 6A, 7A, 7B:
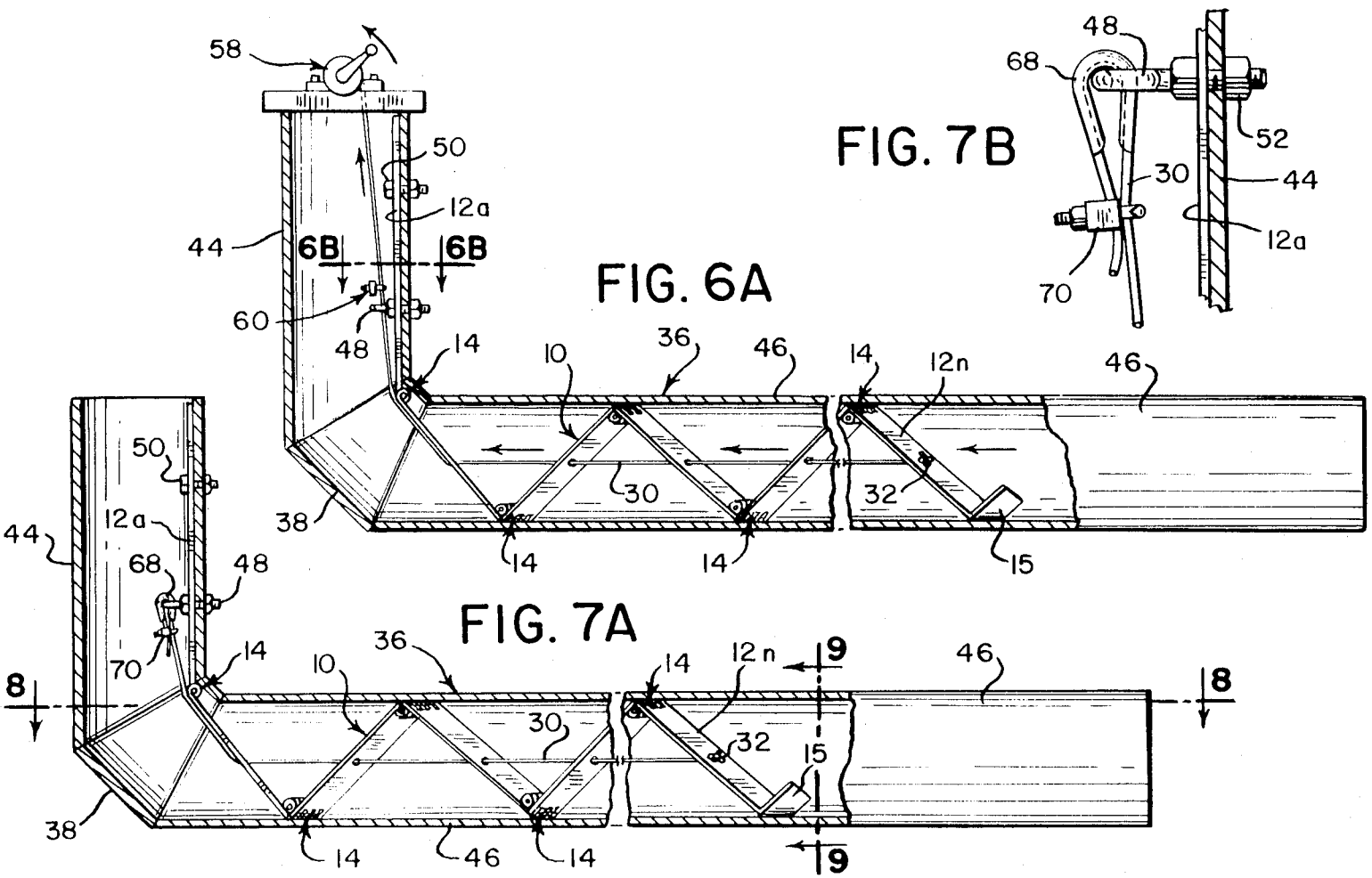
FIG. 6A is another view similar to FIG. 4 showing another step in the installation procedure.
FIG. 7A is another view similar to FIG. 4 showing another step in the installation procedure.
FIG. 7B is a fragmentary elevational view, partly in section, showing the preferred method of securing the free end of the turbulator cable.
Figure 8:
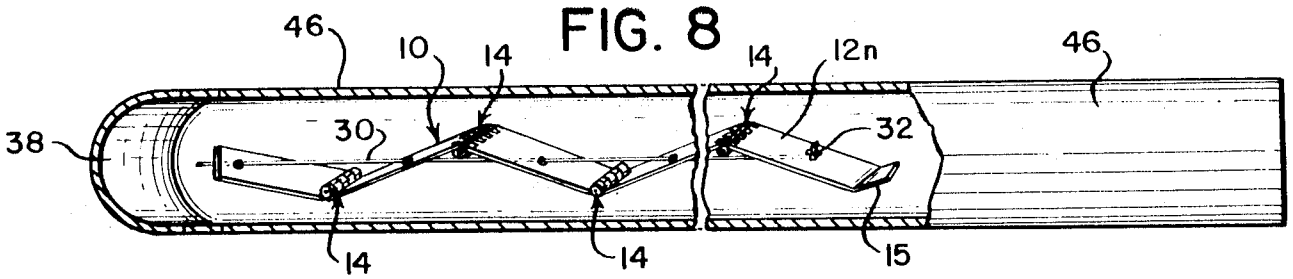
FIG. 8 is a sectional view taken substantially along the lines 8—8 in FIG. 7A.
Figure 9:
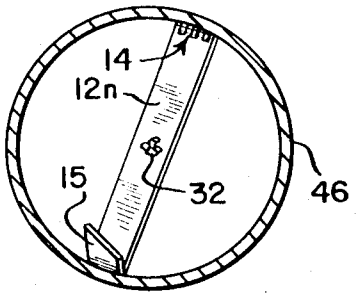
FIG. 9 is a sectional view taken substantially along the lines 9—9 in FIG. 7A.

Referring now to FIG. 6A, the winch 58 is now activated thereby hoisting the cable 30 upwards. Because the turbulator section 12*a* is secured to the wall of pipe leg 44, the cable 30, which is secured at its other end to the section 12*n*, exerts a compressive force on the turbulator 10 tending to pull the turbulator sections 12*b*–12*n* closer together. This is accommodated by pivoting of the angled hinges 14. The angled hinges 14 pivot until alternate hinges are abutting opposite sides of the pipe leg 46 (FIG. 6). the attainment of this position will be apparent both from the substantially increased resistance encountered by the winch 58 as well as the noise which results as the hinges 14 strike the wall of the pipe leg 46. It will now be apparent from FIG. 6 that the bodies of the angled hinges 14 preferably alternately project from the top and bottom surfaces 20, 22 of the turbulator 10 so that when the turbulator 10 assumes the FIG. 6 position, the projecting portions of the hinges 14 are disposed within the acute angles defined by adjacent turbulator sections. Thus, although the hinges 14 accommodate some movement of the sections 12 in the other direction, the range of movement necessary to reach the FIG. 6 position is only attainable if the section 12 are rotated toward the hinge bodies. It will also now be apparent that except for the hinge 14 joining sections 12*a* and 12*b*, the remaining hinges 14 are angled so that the faces of the sections 12*c*–12*n* will assume oblique positions relative to the axis of the pipe leg 46. This is desirable if the turbulator 10 is to have maximum effect.

After the turbulator 10 has assumed the position illustrated in FIG. 6A, a cable clamp 60 is applied above eye bolt 48. Referring to FIG. 6B, cable clamp 60 comprises a U-bolt 62, a clamping member 64 and nuts 66. The cable 30 is then cut above the clamp 60, whereupon clamp 60 prevents the turbulator 10 from returning to the collapsed position. After the winch 58 is removed, and as best shown in FIGS. 7A and 7B, a U-shaped cable thimble 68 is then inserted in the eye bolt 48 and the cable 30 seated therein. The confronting cable portions are then secured together by another cable clamp 70. The clamp 60 is then removed, thereby completing the insertion procedure. The turbulator 10 is now ready for use in the usual manner. To extract the turbulator 10 from the pipe 36, the cable 30 is disconnected from the eye bolt 48 and the bolts 48, 50 are removed. The turbulator may then be pulled out of the pipe as by crane hook 45, the hinges 14 again accommodating movement about the elbow 38.

Figure 10:
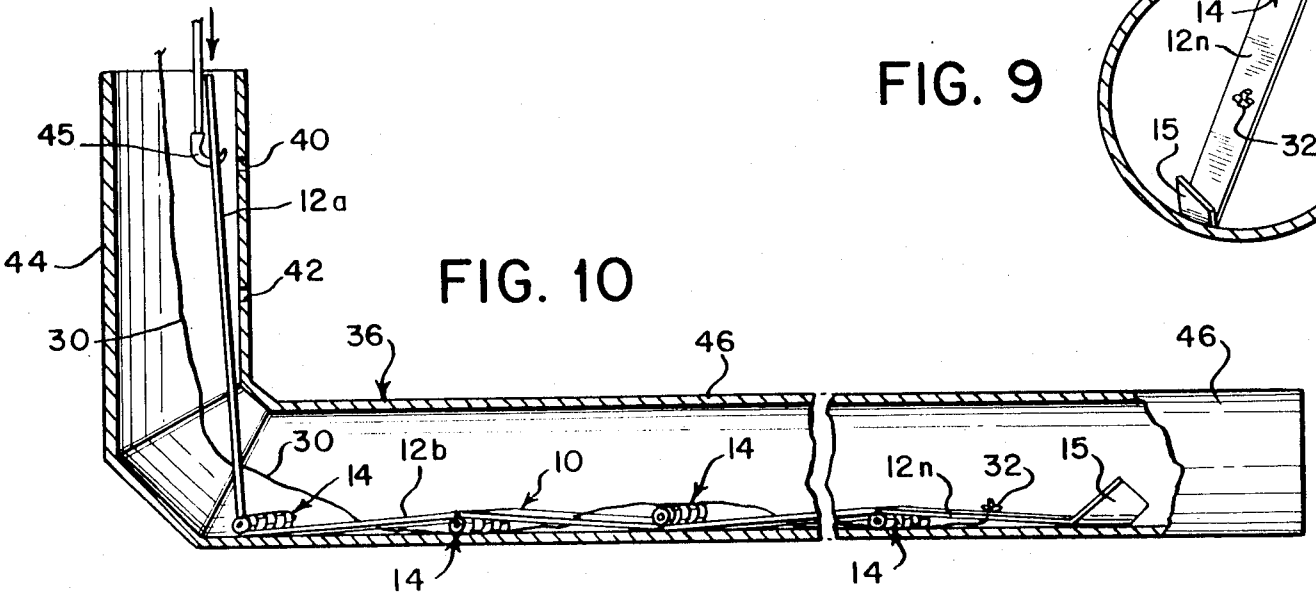
FIG. 10 is a view similar to FIG. 4 showing a step in the installation of a modified turbulator in accordance with the present invention.
Figures 11, 12:
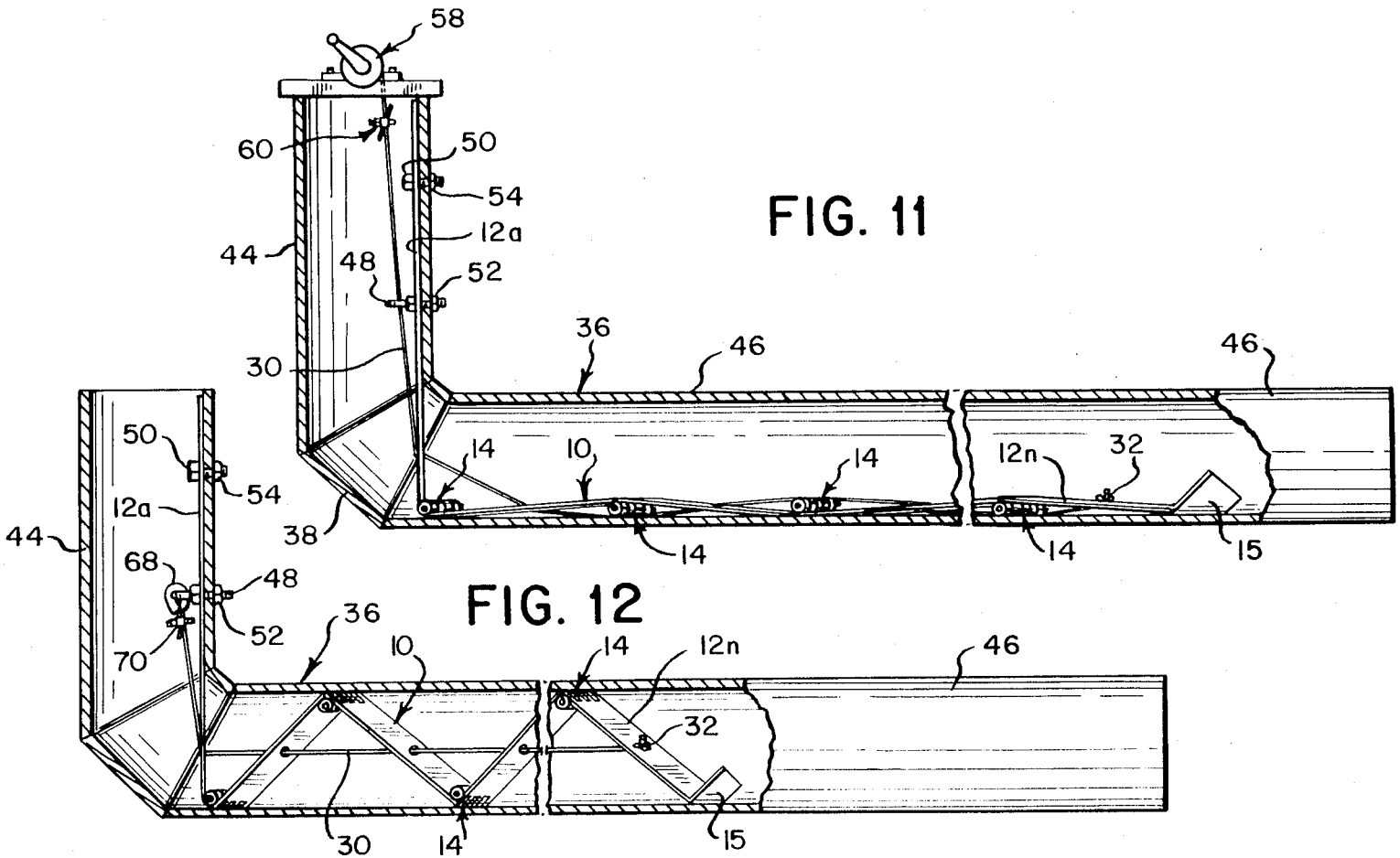
FIG. 11 is a view similar to FIG. 10 showing another step in the installation procedure for the modified turbulator.
FIG. 12 is another view similar to FIG. 10 showing another step in the installation procedure for the modified turbulator.

The method of inserting the collapsible turbulator 10 in accordance with the present invention has been described in FIGS. 1–9 on the assumption that the number of turbulator sections **12*b*–12*n* is odd. Referring now to FIGS. 10–12, if the number of turubular sections 12*b*–12*n* is even, the method of insertion is slightly different. More particularly, and initially referring to FIG. 10, when the number of turbulator sections 12*b*–12*n* is even, the tubulator 10 is lowered into the pipe 36 until the non-angled hinge 14 connecting sections 12*a* and 12*b* rests on the pipe wall in the vicinity of the outside bend of the elbow 38. This is to be contrasted with FIG. 4, wherein it may be seen that the non-angled hinge 14 is only lowered until it reaches the inside bend of the elbow 38. As will be apparent from FIGS. 11 and 12**, the remaining installation steps are precisely the same.

While I have herein shown and described the presently preferred collapsible turbulator in accordance with the present invention and the preferred method of inserting same in a bent pipe, those skilled in the art will appreciate that various changes and modifications may be made therein without departing from the spirit and scope of this invention. Accordingly, the above description should be construed as illustrative and not in a limiting sense, the scope of the invention being defined by the following claims.

I claim:

1. A collapsible turbulator comprising:

(a) a plurality of substantially rigid turbulator sections, including a leading section, at least one intermediate section and a trailing section;

(b) hinge means for joining together adjacent turbulator sections for relative pivotal movement between a longitudinally extended position wherein the adjacent turbulator sections are substantially coplanar and a contracted, operative position wherein the adjacent turbulator sections are pivoted to be oriented angularly with respect to each other; and (c) flexible cable means adapted to actuate the turbulator sections from the extended position to the contracted position, the cable means being secured at one end to the leading turbulator section and extending longitudinally of the turbulator, a tensile force applied to the unsecured end of the cable means causing relative pivotal movement between the adjacent turbulator sections.

2. A collapsible turbulator according to claim 1 wherein each hinge means defines a pivot axis and connects ends of adjacent turbulator sections together for pivotal movement about the pivot axis.

3. A collapsible turbulator according to claim 2 wherein at least part of the hinge means are integrally formed with the turbulator sections.

4. A collapsible turbulator according to claim 3 wherein:

(a) the turbulator sections are disposed adjacent to each other in a longitudinally extending series defining a longitudinal axis; and (b) the pivot axes defined by at least some of the hinge means form acute angles with the longitudinal axis of the turbulator sections.

5. A collapsible turbulator according to claim 4 wherein the pivot axis defined by a hinge connecting the trailing turbulator section with the adjacent turbulator section is perpendicular to the longitudinal axis of the turbulator sections.

6. A collapsible turbulator according to claim 1 wherein:

(a) at least some of the turbulator sections are provided with holes; and (b) the cable means extends through the holes.

7. A collapsible turbulator according to claim 6 wherein the holes are substantially in the centers of the turbulator sections.

8. A collapsible turbulator according to claim 1 wherein the trailing turbulator section is adapted to secure the turbulator within a pipe.

9. A collapsible turbulator according to claim 8 wherein the trailing turbulator section includes means to guide movement of the cable means past the trailing turbulator section.

10. A collapsible turbulator comprising:

(a) first, second and third substantially rigid turbulator sections;

(b) first hinge means connecting a back end of the first turbulator section to a front end of the second turbulator section for pivotal movement between an extended position wherein the first and second turbulator sections are substantially coplanar, and a collapsed, operative position wherein the first and second turbulator sections alternately extend forwardly upward and forwardly downward;

(c) second hinge means connecting a back end of the second turbulator section to a front end of the third turbulator section for a pivotal movement between an extended position wherein the second and third turbulator sections are substantially coplanar, and a collapsed, operative position wherein the second and third turbulator sections alternately extend forwardly upward and forwardly downward; and (d) flexible cable means engaging the first turbulator section and extending rearward therefrom past the second and third turbulator sections and adapted to pull the first turbulator section rearward and thereby force the first, second, and third turbulator sections from their extended positions to their collapsed positions.

11. A collapsible turbulator according to claim 10 wherein:

(a) the first hinge means includes a first hinge defining a first pivot axis and connecting the back end of the first turbulator section to the front end of the second turbulator section for pivotal movement about the first pivot axis; and (b) the second hinge means includes a second hinge defining a second pivot axis and connecting the back end of the second turbulator section to the front end of the third turbulator section for pivotal movement about the second pivot axis.

12. A collapsible turbulator according to claim 11 wherein:

(a) the first, second, and third turbulator sections each have a hole; and (b) the flexible cable extends through the holes of the first, second, and third turbulator sections.

13. A collapsible turbulator according to claim 12 wherein:

(a) the holes are located substantially in the centers of the turbulator sections; and (b) the cable alternately extends above and below the first and second hinge means.

* * * * *